United States Patent [19]

Andersson et al.

[11] Patent Number: 4,518,265

[45] Date of Patent: May 21, 1985

[54] AGITATOR

[75] Inventors: Arne Andersson, Partille; Peter Larsson, Stenkullen, both of Sweden

[73] Assignee: Trilack Utrustningar AB, Sweden

[21] Appl. No.: 478,517

[22] Filed: Mar. 24, 1983

[30] Foreign Application Priority Data

Mar. 26, 1982 [SE] Sweden ..... 8201925

[51] Int. Cl.[3] ..... B01F 7/24

[52] U.S. Cl. ..... 366/318

[58] Field of Search ..... 366/308, 318, 347, 349, 366/605, 319, 320, 321, 322, 323, 324, 343, 197, 201, 207, 129, 605; 99/348

[56] References Cited

U.S. PATENT DOCUMENTS

| | | | |
|---|---|---|---|
| 1,775,345 | 9/1930 | Henschel | 366/605 X |
| 3,455,540 | 7/1969 | Marcmann | 366/129 X |
| 3,975,469 | 8/1976 | Fuchs | 366/318 |
| 4,264,215 | 4/1981 | Nunlist et al. | 366/343 |

*Primary Examiner*—Philip R. Coe

[57] ABSTRACT

Agitator for the stirring of liquids which are enclosed in vessels the inner space of which is accessible through a hole in the wall of the vessel and of a small dimension compared to the dimension of the vessel, the agitator comprising an actuating organ and a turnable shaft for the rotation of the organ, which organ has the form of a screw with a larger diameter than said hole. The thread of the screw is formed of a coiled stripe the width of which is smaller than the width of the largest cross section of the hole and with a pitch which is so large compared to the thickness of the stripe and the height of the walls of said hole that, when the stripe forming the thread is inserted into the hole with a portion positioned on the one side of the center axis of the screw, the portions forming the thread on the opposite side of the axis will find room outside the projection of the hole at both sides of the wall through which the hole extends. The screw can in this position be screwed through the hole until the shaft is placed within the hole.

3 Claims, 4 Drawing Figures

AGITATOR

The present invention relates to an agitator for the stirring of liquids which are enclosed in vessels the inner space of which is accessible through a hole in the wall of the vessel and of a small dimension compared to the dimension of the vessel, the agitator comprising an actuating organ and a turntable shaft for the rotation of the organ. For certain kinds of liquids, for example emulsions or suspensions, stirring is necessary to bring the liquid to a homogeneous state. Stirring is e.g. necessary for paints comprising colour pigment before the paint can be used. For industrial use especially spray painting it has earlier been usual to deliver the paint in transport drums with a removable end cover, usually the type of drums with a ring lock for the cover. In such vessels the cover can be replaced with a device which includes an agitator and a suction nozzle for the paint. Agitators of this kind are usually of the propeller type agitator with a number of blades around the periphery of a disc which in the working position is horizontal.

However, in increasing degrees one has changed to the use of transport drums with an end cover which is not removable. Instead, for the emptying of the drums, a smaller cover has been provided covering an opening of the size of some tenths of a millimeter in diameter. Naturally such a cover is safer with regards to unintended overflow e.g. by shocks and dropping during transport. To remove the liquid in the vessel through such an opening does not present any difficulties, it is only necessary to insert a suction pipe. It has however been difficult to provide an efficient stirring of the liquid. Propeller agitators will be so small in diameter if they are adapted to be inserted through the opening and will not be efficient. Stirring through e.g. injection of air has disadvantages such as oxidation of the liquid and production of foam. There is therefore presently a need for an agitator, which is efficient also if it has to be dimensioned for the insertion through a smaller opening.

The object of the invention is to provide an agitator according to this need. The objects of the invention are obtained by means of an agitator with an actuating organ having the form of a screw with a larger diameter than said hole, in which screw the thread is formed of a stripe the width of which is smaller than the width of the largest cross section of the hole and with a pitch which is so large compared to the thickness of the stripe and the height of the walls of said hole that, when the stripe forming the thread is inserted into the hole with a portion positioned on the one side of the center axis of the screw the portions forming the thread on the opposite side of the axis will find room outside the projection of the hole at both sides of the wall through which the hole extends.

In the accompanying drawings an embodiment of the invention is shown.

Figure 1:
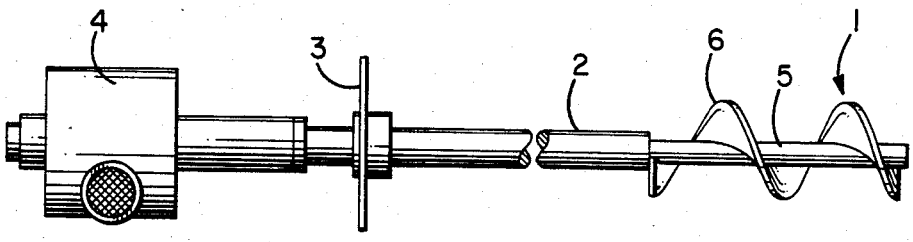
FIG. 1 shows the agitator as a complete unit.

The basic idea of the invention is that the agitator is provided in the form of a screw in which a thin, coiled stripe on a central core forms the thread. Preferably the screw is formed with the stripe manufactured of a band of sheet or a flat bar, which has been coiled to screw form and has been attached for example by means of welding to the core, which has the form of a rod or pipe, preferably with a circular section.

Such screws are prior known and have been used e.g. for the pumping of water.

However, it has in connection with the invention been shown that such screws are efficient agitators. By means of a suitable adaption of the length of the screw the liquid will be lifted a considerable height in the vessel and will at the upper end of the screw be moved outwards and will thereafter sink along the wall of the vessel outside the upwards moving liquid column so that the entire volume of liquid will be in motion. It has however been shown that in spite of the advantageous effect of such a screw it will be limited in stirring effect if the size of the opening is very small compared to the dimension of the vessel and the screw is adapted to the size of the opening. In a vessel with the diameter of about 800 mm and an opening of about 50 mm, a screw, which is a little smaller than the opening is too small to provide an efficient stirring of the entire liquid volume. According to the invention the screw is shaped in a way that it can be inserted through a hole which is considerably smaller than the outer diameter of the screw. So it is e.g. possible to insert a screw of about 90 mm diameter in a hole of 50 mm diameter and still better proportions can be obtained. A screw of this diameter is sufficient to obtain an efficient stirring in a vessel of the size mentioned.

The possibility to insert a screw through a hole with a smaller diameter than the screw is based on the conditions that the mentioned core is relatively small compared to the outer diameter of the screw. At the same time the material stripe which forms the thread is in a thin material and with a relatively large pitch. Hereby the thread can extend in an oblique angle through the hole so that it is only necessary to find room for the portion of the stripe forming the thread, which is positioned at the one side of the core, and for the core. The stripe forming the thread on the opposite side of the core winds away outwards and inwards respectively and is positioned inside and outside of the wall of the hole. In this way and in this oblique position the screw consequently can find room in the hole and it can in its whole length be inserted through the hole by being screwed through the same with the thread placed out of the center of the hole. From the inner end of the thread a shaft forming an extension to the core extends so when the screw with its threads have been screwed through the hole the entire thread is positioned inside the vessel and only the shaft has to extend out through the hole. In a similar way the screw can also be screwed out through the hole.

In order to obtain said conditions it is as mentioned necessary that the material in the thread is not too thick and that the pitch will not be smaller than a certain value. It is also necessary that the material thickness around the hole is not too large.

In the figures an embodiment of the agitator is shown. FIG. 1 shows the agitator as a complete unit. The said screw is indicated with 1. It extends from tubular shank 2 which encloses a shaft by means of which the screw can be rotated. A collar 3 limits the insertion of the agitator through said opening. On the opposite side of the collar 3 in relation to the screw 1 is placed a motor 4 for the turning of the shaft so that the screw can be rotated. The shank 2 and the collar 3 will not rotate.

Figure 2:
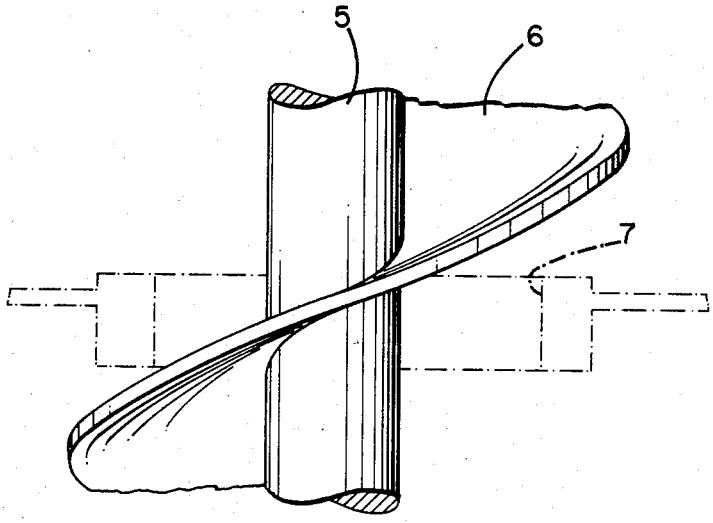
FIGS. 2 and 3 show in two directions views, which are seen in two perpendicular to each other, insertion of the actuating organ of the agitator through a hole.
Figure 3:
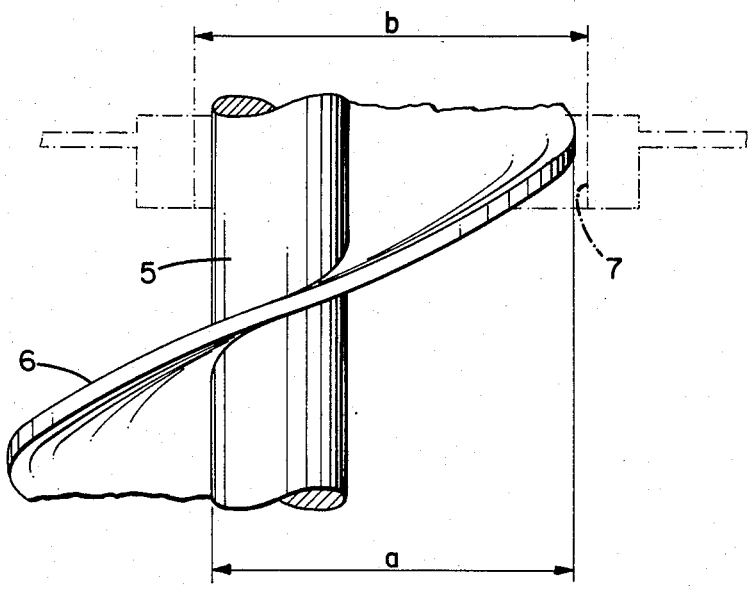
Figure 4:
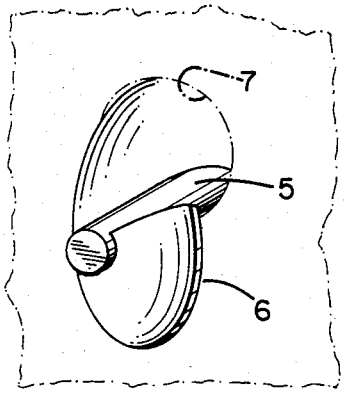
FIG. 4 shows the insertion in an end view.

Evident from the figures are the core 5 of the screw and its thread 6 in the form of a coiled stripe. The thread is terminated a short length from the end of the shank 2. In FIG. 3 a measure is shown extending over the core and the one side of the thread, which measure has to be smaller than the diameter b of the hole 7 in the vessel in which the stirring has to be provided. As the intention is that also the shank 2 shall be inserted through the hole the shank must not be larger than the measure a. In FIGS. 2 and 3 there are shown two sections perpendicular to each other of the screw 1 during the screwing through the hole 7. As is evident from FIG. 3 the core 5 is out of center in the hole 7. In FIG. 4 substantially the same position as in FIG. 2 is shown but in a view from the inside of the vessel, consequently a view of the screw 1 with the core 5 and the thread 6 during the insertion through the hole 7. From this figure it is evident how the thread extends in an oblique angle through the hole 7 during the insertion.

It is not necessary that the screw be provided with a core but it can be formed of the stripe only. The core extending throughout the screw will however make the screw more rigid and make it easier to statically balance the same. Further, the core forms an extension to the shaft, which is necessary for the turning of the screw. As mentioned, it is necessary that the thread which has a larger diameter than the opening is connected to a narrower portion which will find room in the space when the thread of the screw is inserted through the same and the axis of the screw is brought to a position which is substantially parallel to the walls of the vessel and perpendicular to the cover through which said hole extends.

We claim:

1. An agitator for stirring of liquids which are enclosed in vessels, said vessels having an outer dimension, an inner space, a wall having a thickness, and a hole in said wall, said inner space being accessible through said hole, said hole having a diameter which is substantially smaller than said outer dimension of a vessel, the agitator comprising a screw and a turnable shaft for the rotation of the screw, said screw having a center axis and a thread formed of a coiled body in the form of a stripe having portions located on opposite sides of said center axis, said stripe having a diameter which is larger than the diameter of said hole and a thickness which is smaller than the thickness of said wall and being coiled with a pitch which is so large compared to the thickness of the stripe and the thickness of the wall that, when the stripe is inserted into the hole with one of said portions thereof which is located on one of said sides of the center axis of the screw, the portions of said stripe on the other of said sides of the center axis and forming continuing extensions in both directions of the axis to the said one of said portions of the stripe will find room outside of the hole at both sides of the wall so that the screw together with said shaft can be screwed through the hole with the entire stripe forming the thread until the shaft is placed within the hole and the screw can be rotated within the vessel by turning the shaft.

2. An agitator according to claim 1, wherein the shaft extends as a core within at least a part of the coiled stripe, and the measure over the core and said one of said portions of the stripe is smaller than the diameter of the hole.

3. An agitator according to claim 1, wherein said shaft has a collar at one end thereof and said screw is located at an opposite end of said shaft, said collar having a dimension which is larger than the diameter of said hole, and there is provided a driving unit for the turning of the screw on a side of the collar opposite to a side from which the shaft extends, the length between the side of the collar from which the shaft extends and the end of the screw being shorter than the distance in the vessel between the outside of the wall having the hole therein and inside of an opposite wall such that when the screw is inserted into the vessel with said collar resting against the wall having the hole therein, the end of the screw will be close to said opposite wall of the vessel.

* * * * *